US006523821B2

(12) United States Patent
Kashiwagi et al.

(10) Patent No.: US 6,523,821 B2
(45) Date of Patent: Feb. 25, 2003

(54) PAPER FEEDER APPARATUS FOR USE WITH IMAGE FORMING APPARATUS

(75) Inventors: Nobuyuki Kashiwagi, Ikoma (JP); Masami Fuchi, Katano (JP); Yasuyuki Hirai, Yao (JP); Yoshihiro Yamaguchi, Habikino (JP); Yukio Hashimoto, Shijonawate (JP); Masaki Higashiyama, Daito (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/790,155

(22) Filed: Feb. 21, 2001

(65) Prior Publication Data

US 2001/0015521 A1 Aug. 23, 2001

(30) Foreign Application Priority Data

Feb. 23, 2000 (JP) ..... 2000-046229
Feb. 23, 2000 (JP) ..... 2000-046230

(51) Int. Cl.[7] ..... B65H 1/00
(52) U.S. Cl. ..... 271/145; 271/264; 271/154
(58) Field of Search ..... 271/145, 146, 271/147, 154, 155, 264, 157, 158

(56) References Cited

U.S. PATENT DOCUMENTS 3,827,803 A * 8/1974 Shelffo et al. ..... 271/277
4,433,905 A * 2/1984 Haramaki et al. ..... 271/212
4,447,097 A * 5/1984 Lafevers et al. ..... 271/149
RE32,281 E * 11/1986 Tsubo ..... 271/157 X
4,852,869 A * 8/1989 Watanabe et al. ..... 271/126
5,100,119 A * 3/1992 Komada et al. ..... 270/58.14
5,165,571 A * 11/1992 Schlumpf ..... 194/346
5,411,246 A * 5/1995 Nonomura et al. ..... 271/117
5,794,928 A * 8/1998 Araseki et al. ..... 271/126

* cited by examiner

*Primary Examiner*—Christopher P. Ellis
*Assistant Examiner*—Richard Ridley
(74) *Attorney, Agent, or Firm*—Jordan and Hamburg LLP

(57) ABSTRACT

A feeder apparatus arranged on a side of a main body of an image forming apparatus is provided with a top door and a vertical door. The top door is provided in an opening defined above a sheet stacker, and the vertical door is provided in an opening defined on a side of the sheet stacker to enable an operator to replenish sheets inside the feeder apparatus. Switches are provided to detect as to whether the top door or the vertical door is opened. The feeder apparatus is constructed in such a manner that upward movement of the sheet stacker is suspended when the top door is detected to be opened and that upward and downward movement of the sheet stacker is suspended when the vertical door is detected to be opened.

15 Claims, 7 Drawing Sheets

PAPER FEEDER APPARATUS FOR USE WITH IMAGE FORMING APPARATUS

BACKGROUND OF THE INVENTION

1. Field of the Invention

This invention relates to a paper feeder apparatus for use with an image forming apparatus such as copier, facsimile machine, and printer to feed recording paper sheets to a main body of the image forming apparatus for image formation.

2. Description of the Prior Art

There have been known a detachably attachable feeder apparatus (generally, in the form of paper feeder deck) which is disposed on a side of a main body of an image forming apparatus such as copier, facsimile machine, and printer, and accommodates as large as several thousands of sheets therein. Such a feeder apparatus comprises a sheet stacker on which several thousands of sheets are stacked, a sheet stacker elevating mechanism for drivingly moving the sheet stacker up and down, and a feeding mechanism disposed above the sheet stacker to dispense the sheets one by one toward the apparatus main body. The sheet stacker elevating mechanism is actuated to move the sheet stacker upward stepwise as the sheets are dispensed one by one so that the sheets stacked on the sheet stacker are fed to the feeding mechanism one by one.

The feeder apparatus is equipped with a door so that an operator accesses inside the feeder apparatus to replenish sheets therein. The door is formed on either a side portion or an upper portion of the feeder apparatus.

In the case of a feeder apparatus provided with a side door, the sheet stacker is lowered prior to opening of the side door. Upon lowering of the sheet stacker, the side door is allowed to open so that the operator can replenish sheets into the feeder apparatus. In this type of feeder apparatus, up and down movement of the sheet stacker is prohibited during opening of the side door because the upper and lower spaces above and below the sheet stacker are exposed outside during the opening of the side door which resultantly may cause intrusion of foreign matters in an element inside the feeder apparatus. The above type of feeder apparatus makes it easier to replenish sheets because the operator is enabled to stack sheets on the sheet stacker through a side opening defined by opening of the side door. This type of feeder apparatus, however, has a limitation for installation because the feeder apparatus requires an additional space which allows the operator to open the side door.

In the case of a feeder apparatus provided with a top door, the operator opens the top door first. Upon confirming that the top door has been opened, the sheet stacker is lowered stepwise. When the sheet stacker is lowered to a certain position, sheet replenishing operation is allowed. In this type of feeder apparatus, upward movement of the sheet stacker during opening of the top door is prohibited because the upper space above the sheet stacker is exposed outside during the opening of the top door and foreign matters may likely to intrude in an element inside the feeder apparatus during the opening.

In the latter type of feeder apparatus, sheet replenishing can be performed by opening the top door which is easily accessible for an operator standing generally in front of the image forming apparatus main body. This type of feeder apparatus has less limitation for installation because the feeder apparatus does not require an additional space which is required for the former type of feeder apparatus. The latter type of feeder apparatus, however, has a difficulty in securing a large opening at an upper part of the feeder apparatus because the feeding mechanism is provided at the upper part of the feeder apparatus. In addition to this disadvantage, replenishing of sheets through the upper opening involves vertical movement for the operator to stack the sheets onto the sheet stacker. This stacking operation by the operator may likely to cause damage of corner end(s) of the sheet(s) or displaced stacking onto the sheet stacker.

SUMMARY OF THE INVENTION

An object of this invention is to provide a paper feeder apparatus for use with an image forming apparatus which has solved the aforementioned problems residing in the prior art.

Another object of the invention is to provide a paper feeder apparatus which has less limitation for installation and enables an operator to adequately replenish sheets depending on the installed place for the image forming apparatus.

According to an aspect of the invention, a feeder apparatus is arranged on a side of a main boy of an image forming apparatus. The feeder apparatus comprises a housing having a top opening and a vertical opening, a sheet stacker provided in the housing for holding a stack of sheets thereon, an elevating drive mechanism for moving the sheet stacker up and down, a feeding mechanism provided above the sheet stacker to feed the sheets one by one in a sheet transport direction to the image forming apparatus main body, a top door for closing and opening the top opening and allowing an operator to replenish sheets onto the sheet stacker from the top opening in an opened state, and a vertical door for closing and opening the vertical opening and allowing an operator to replenish sheets onto the sheet stacker from the vertical opening in an opened state.

With this arrangement, the operator is enabled to replenish sheets onto the sheet stacker by opening the top door. This arrangement enables to install the image forming apparatus in a relatively small space. In the case where there is provided a space sufficient for allowing the operator to open the vertical door, the operator can select a sheet replenishing manner depending on a situation such that the top door is opened to replenish a small number of sheets and the vertical door is opened to replenish a large number of sheets.

These and other objects, features and advantages of the present invention will become more apparent upon a reading of the following detailed description and accompanying drawings.

DETAILED DESCRIPTION OF THE PREFERRED EMBODIMENTS OF THE INVENTION

A paper feeder apparatus according to an embodiment of the invention is described by taking a paper feeder apparatus which is designed to be connected with an outside of a copying machine. First, an entire construction of the copying machine connected with the paper feeder apparatus is described, and then, an arrangement of the paper feeder apparatus is described.

Figure 1:
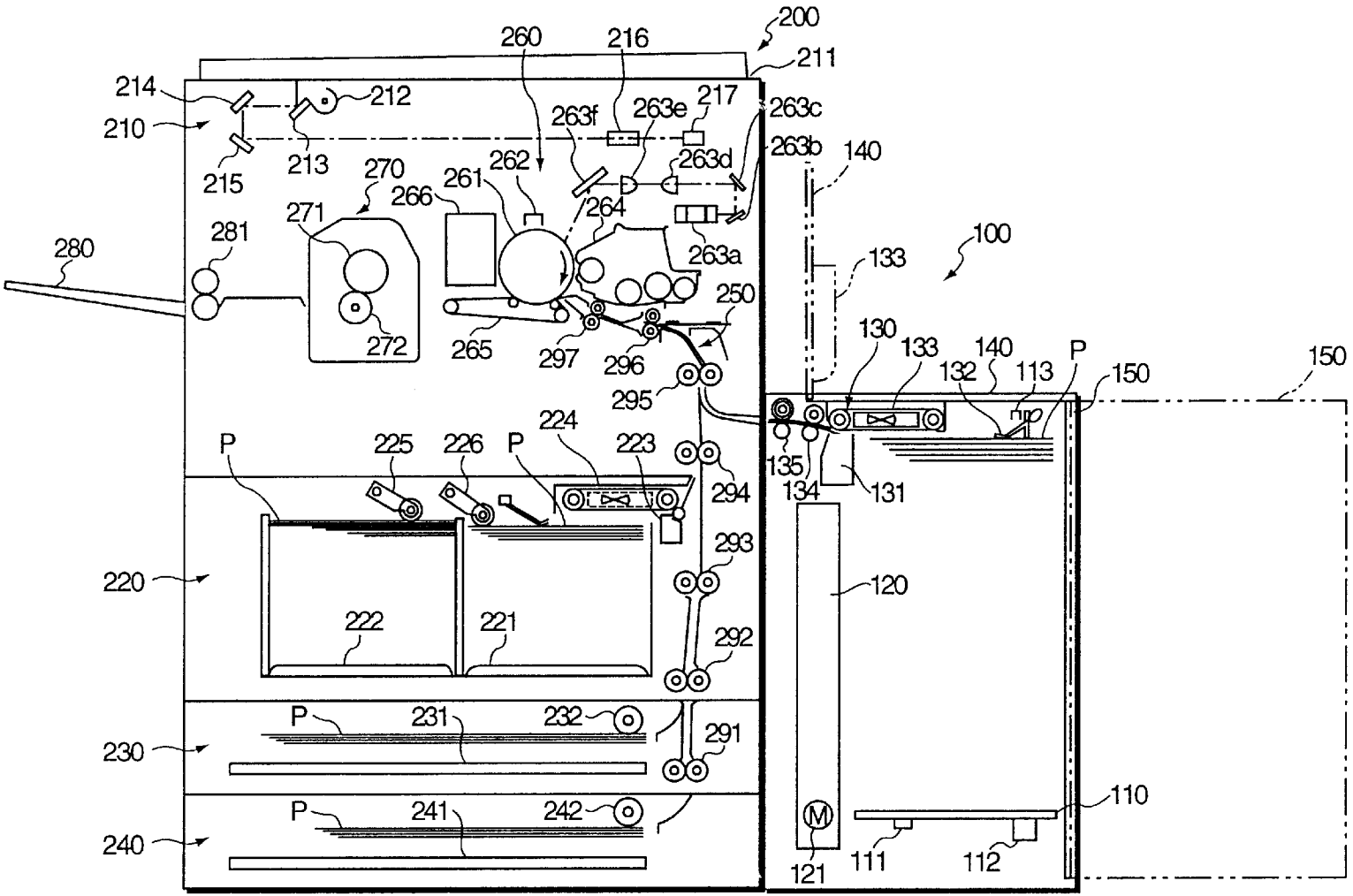
FIG. 1 is a schematic diagram showing an entire construction of a copying machine attached with a paper feeder apparatus according to an embodiment of the invention.

FIG. 1 is a diagram showing an entire construction of the copying machine. As shown in FIG. 1, the copying machine comprises a main body 200 and a feeder apparatus 100 (in the form of a paper feeder deck) which is detachably attached to a side of the machine main body 200.

The entire construction of the machine main body 200 is as follows. The main body 200 comprises an image reader section 210 for reading an image of an original document G, sheet storage sections 220, 230, 240 each adapted for accommodating sheets therein, an image transfer section 260 in which an image read by the image reader section 210 is developed and transferred onto a sheet as a toner image, and a fixing section 270 for fixing the toner image onto the sheet.

The image reader section 210 comprises a document setter 211 on which the original document G is placed, an exposure lamp 212 for projecting light onto the document G placed on the document setter 211, mirrors 213, 214, 215 for reflecting light from the document G, and a CCD 217 for reading the light image via a focusing lens 216.

The sheet storage section 220 includes two sheet stackers 221, 222 each of which is designed to stack a number of sheets P and move upward stepwise as the sheets P are dispensed with.

An air-blower type sheet separator 223 and an air-suction type sheet transporter 224 are provided at a certain position above the sheet stacker 221 downstream (right side in FIG. 1) with respect to the sheet transport direction. The sheet separator 223 blows air onto an upper part of the stacked sheets P on the sheet stacker 221 to separate the uppermost sheet from the rest of the stacked sheets P. The sheet transporter 224 transports the floated uppermost sheet in the sheet transport direction while drawing air to attract the uppermost sheet thereto. The sheet separator 223 and the sheet transporter 224 constitute an air-type feeding mechanism. The construction of the air-type feeding mechanism used in the machine main body 200 is substantially the same as that used in the feeder apparatus 100 which is described in a later section. Therefore, a detailed description on the construction of the air-type feeding mechanism used in the machine main body 200 is omitted in this section.

After the sheets P stacked on the sheet stacker 221 are dispensed, then, the sheets P stacked on the sheet stacker 222 which is disposed upstream (left side in FIG. 1) with respect to the sheet transport direction are fed toward the air-type feeding mechanism from the uppermost sheet one by one en route of the sheet stacker 221 by feed rollers 225, 226. Upon reaching a certain position below the air-type feeding mechanism, the uppermost sheet is fed toward the image transfer section 260 by combined actuation of the sheet separator 223 and the sheet transporter 224.

The sheet storage section 230 (240) is adapted to separate a stack of sheets P stacked on a sheet stacker 231 (241) by a feed roller 232 (242) one by one to feed the uppermost sheet toward downstream with respect to the sheet transport direction.

The sheet dispensed from the sheet storage section 220 (230 or 240) is transported to transport roller pairs 291, 292, 293, 294, 295, and 296 in this order, has its oblique transport, if any, corrected by a registration roller pair 297, and transported to the image transfer section 260 in synchronism with a transfer timing by the image transfer section 260. The sheet dispensed from the feeder apparatus 100 is transported to the image transfer section 260 in the same manner as in the sheet storage section 220 (230 or 240).

The image transfer section 260 includes a photosensitive drum 261 which is rotatable about an axis thereof and has photoelectric conductivity. The image transfer section 260 further includes a charger 262, an exposing device 263, a developer 264, a transfer device 265, and a cleaner 266 in this order with respect to the rotating direction of the photosensitive drum 261. The charger 262 supplies a certain potential on the surface of the photosensitive drum 261. The exposing device 263 irradiates a laser beam in correspondence with image data read by the image reader section 210 by a laser oscillator (not shown) to scan the surface of the photosensitive drum 261 via a polygon mirror 263*a*, mirrors 263*b*, 263*c*, a focusing lens 263*d*, a cylindrical lens 263*e*, and a mirror 263*f*, and forms an electrostatic latent image on the drum surface by selectively attenuating the surface potential of the photosensitive drum 261. The developer 264 develops the latent image into a toner image. The transfer device (transfer belt) 265 transfers the toner image onto the sheet P. The cleaner 266 removes charge residue on the surface of the photosensitive drum 261 after the image transfer to thereby remove toner residues.

When the sheet P is transferred to the image fixing section 270 from the image transfer section 260, the sheet P is nipped between a heater roller 271 and a presser roller 272 to fix the toner image onto the sheet P.

The sheet P carrying the fixed toner image is discharged onto a discharge tray 280 via a discharge roller pair 281.

The copying machine main body 200 is further incorporated with a main body controller 400 which controls an overall operation of the main body 200 and optional devices such as the paper feeder deck (feeder apparatus) 100 and a display section 401 which displays a status concerning to various operations about image formation.

Next, a construction of the externally-arranged-type paper feeder apparatus (or paper feeder deck) 100 is described. The feeder apparatus 100 is an optional device which is detachably attached to a side (right side in FIG. 1) of the copying machine main body 200. The feeder apparatus 100 is so constructed as to accommodate a quantitative number of (for instance, the number as large as 4,000) sheets P therein.

The feeder apparatus 100 includes a housing having a top opening 142 in a top of the housing and a vertical opening 152 in a side opposite to the copying machine main body 200, namely, in a rightward direction of the copying machine main body 200 in FIG. 1. The feeder apparatus 100 is provided with a sheet stacker 110 in the housing. The sheet stacker 110 is stacked with a bulky number of sheets P. The feeder apparatus is further provided with an elevating drive mechanism 120 which drivingly moves the sheet stacker 110 up and down, a feeding mechanism 130 which separates the uppermost sheet from the rest of the stacked sheets P on the sheet stacker 110 to feed the uppermost sheet toward the main body 200. In the top opening 142 provided is a top door 140 which is designed to render an upper space relative to the sheet stacker 110 accessible to the operator. In the vertical opening 152 provided is a vertical door 150 which is designed to render a side space relative to the sheet stacker 110 accessible to the operator.

The elevating drive mechanism 120 is constructed in such a manner that a driving force of a drive motor 121 is transmitted to the sheet stacker 110 via a known driving force transmitter mechanism including a wire, pulley, etc. As will be described in the following section, the up and down movement of the elevating drive mechanism 120 is controlled depending on a status as to whether the top door 140 (the vertical door 150) is opened or closed.

Figure 2:
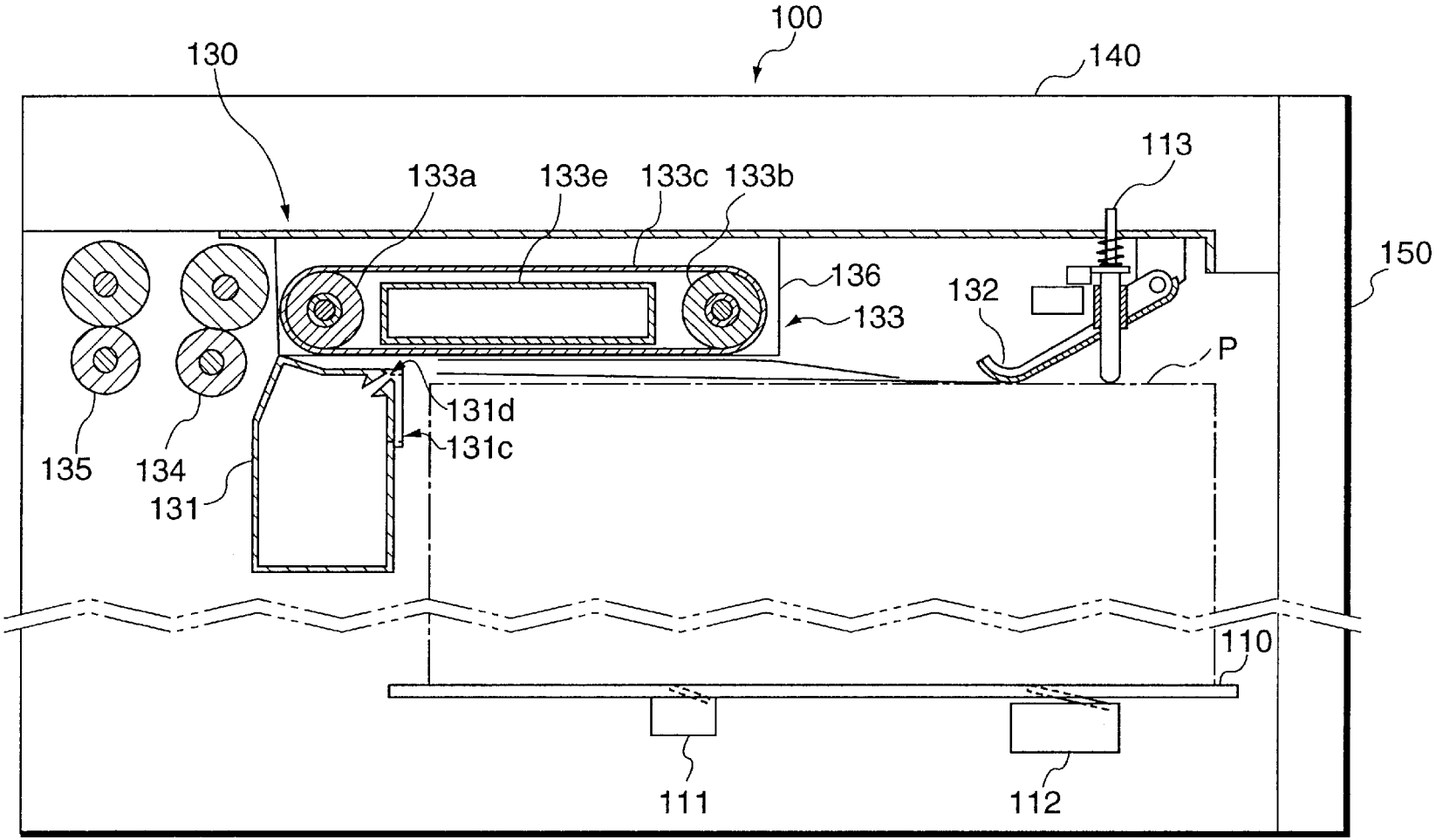
FIG. 2 is an enlarged view showing essential parts of the feeder apparatus.

FIG. 2 is an enlarged view showing essential parts of the feeder apparatus 100. As shown in FIG. 2, the feeding mechanism 130 comprises an air-blower type sheet separator 131, a sheet presser 132, an air-suction type sheet transporter 133, and transport roller pairs 134, 135. The air-blower type sheet separator 131 is actuated in such a manner that air is blown onto a lead end of the stack of sheets P with respect to the sheet transport direction (upper left region of the stack of sheets P on the sheet stacker 110 in FIG. 2) to float and separate the uppermost sheet from the rest of the stacked sheets P. The sheet presser 132 presses a tail end of the uppermost sheet with respect to the sheet transport direction (right side in FIG. 2) against an undesirable float of the tail region of the uppermost sheet due to air blown by the sheet separator 131. The sheet transporter 133 attracts the uppermost sheet which has been separated from the rest of the stacked sheets P toward the air transporter 133 due to air suction force to transport the uppermost sheet in the sheet transport direction. The transport roller pairs 134, 135 are designed to transport the uppermost sheet further downstream with respect to the sheet transport direction.

Figure 3:
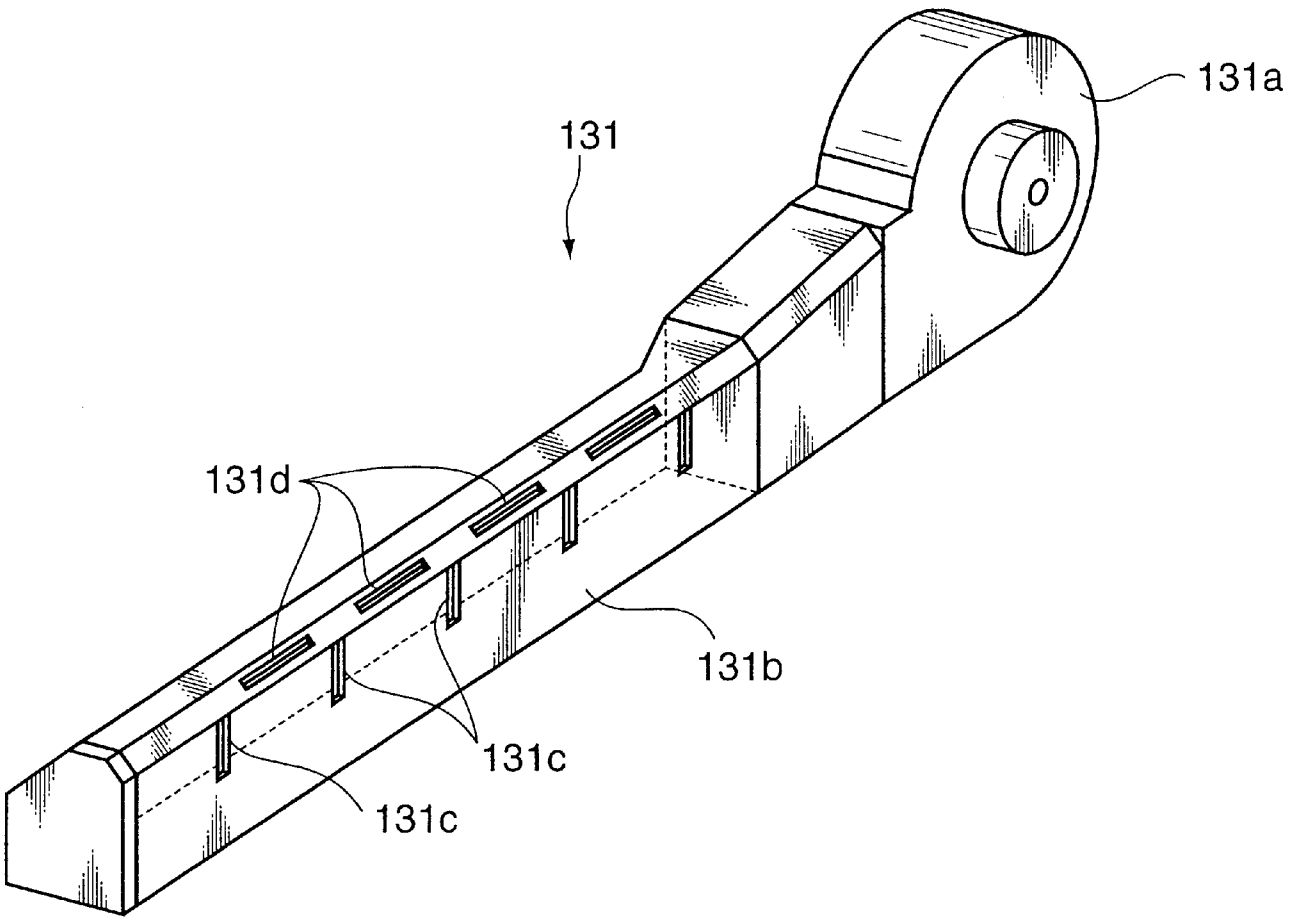
FIG. 3 is a perspective view of an air-blower type sheet separator in the feeder apparatus.

FIG. 3 is a perspective view of the sheet separator 131. As shown in FIG. 3, the sheet separator 131 includes an elongated main body 131*b* which is formed with a hollow space therein and is provided with an air blower source 131*a* at one end thereof. The main body 131*b* is formed with a certain number of vertically oblong air blowing outlets 131*c*, and a certain number of transversely oblong air blowing outlets 131*d*. Air is blown in a substantially horizontal direction through the air blowing outlets 131*c* toward the upper region of the stacked sheets P on the sheet stacker 110 including the uppermost sheet to temporarily float part of the several upper sheets in the air. Simultaneously, air is blown in a substantially obliquely upward direction through the air blowing outlets 131*d* toward the uppermost sheet to separate the uppermost sheet from the rest of the partially floated sheets.

Two of the sheet pressers 132 are disposed away by a certain interval in the widthwise direction of the sheet (in a direction orthogonal to the sheet transport direction). An end of each sheet presser 132 is attached to the upper door 140 to render the sheet presser 132 pivotable. The sheet presser 132 is tilted downwardly toward downstream with respect to the sheet transport direction by the weight thereof in such a manner that the opposite end of each sheet presser 132 comes into contact with the upper surface of the uppermost sheet (see FIG. 2). With this construction, the sheet pressers 132 suppress float of the tail end of the uppermost sheet.

As shown in FIG. 2, the sheet transporter 133 is mounted on the top door 140 by a bracket 136, and is integrally movable together with the top door 140 as the top door 140 is opened and closed.

Figure 4:
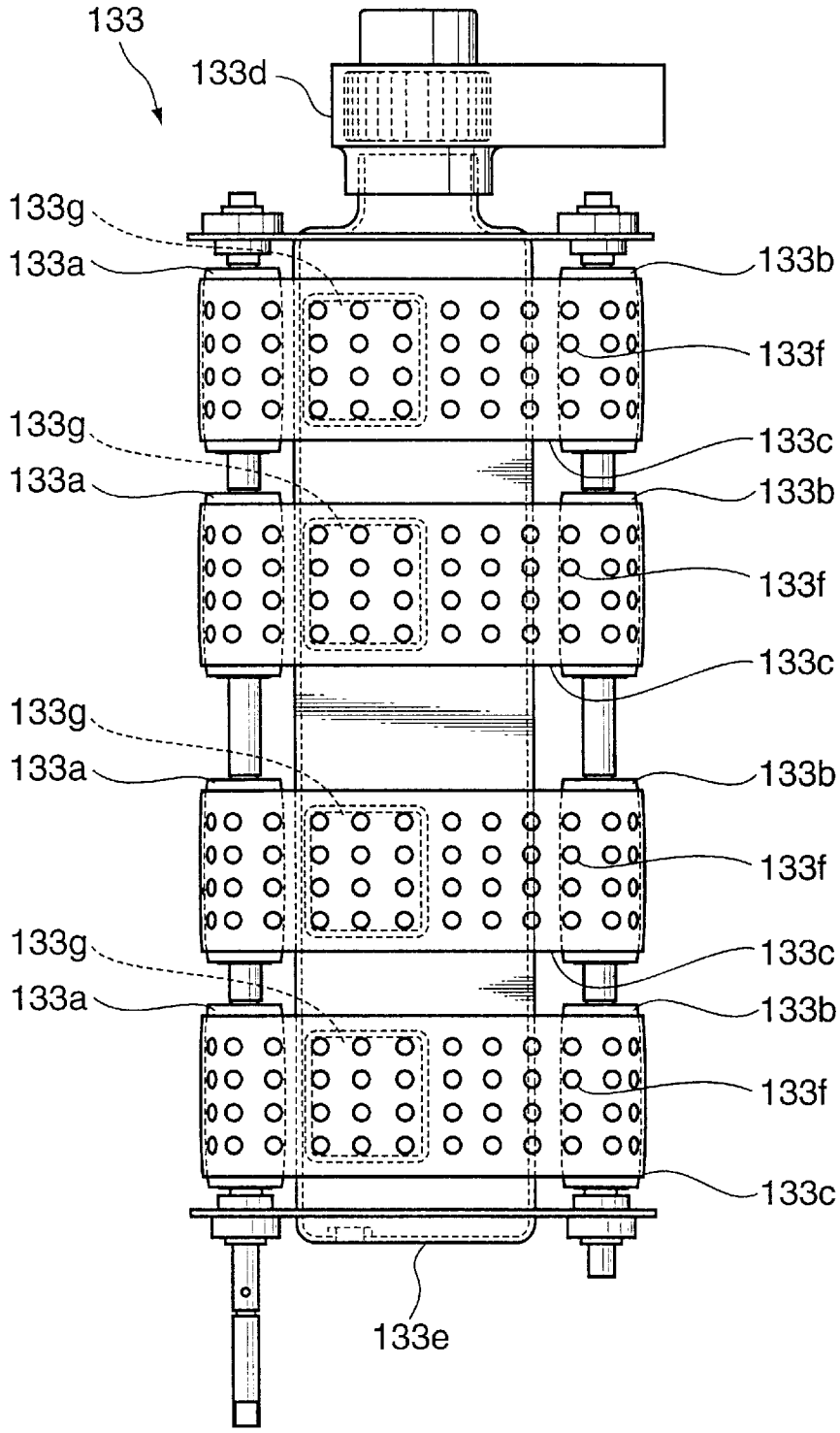
FIG. 4 is an enlarged plan view of an air-suction type sheet transporter viewed from below.

FIG. 4 is a plan view of the sheet transporter 133 viewed from below. As shown in FIG. 4, the sheet transporter 133 includes four drive rollers 133*a* which are drivingly rotated by a drive source (not shown), four driven rollers 133*b*, transport belts 133*c* each of which is stretched around the corresponding drive roller 133*a* and driven roller 133*b*, an air suction fan 133*d* mounted at one end of the sheet transporter 133, and an air suction duct 133*e* disposed inwardly with respect to a transport path defined by traveling of the transport belts 133*c* and extending in a direction substantially orthogonal to the stretched direction of the transport belts 133*c*.

Each of the transport belts 133*c* is formed with a number of holes 133*f*. The air suction duct 133*e* is formed with air suction holes 133*g* each of which is formed at a position opposed to the corresponding transport belt 133*c*. The sheet transporter 133 is operated in such a manner that the air suction duct 133*e* draws air through the air suction holes 133*g* by way of the number of holes 133*c* provided in each of the transport belts 133*c* while moving the transport belts 133*c* carrying the uppermost sheet thereon. With this arrangement, the uppermost sheet is transported toward downstream with respect to the sheet transport direction.

A sheet detecting switch 111 is provided at an appropriate position on the backside of the sheet stacker 110 to detect the presence of sheet on the sheet stacker 110.

A lowermost position detecting switch 112 is provided at an appropriate position below the sheet stacker 110 to detect that the sheet stacker 110 has lowered to the lowermost operable position by the elevating drive mechanism 120.

An upper end detecting switch 113 is provided at an appropriate position above the sheet stacker 110 to detect the position of the uppermost sheet of the stacked sheets P on the sheet stacker 110 so as to operate the elevating drive mechanism 120 in such a manner that the feeding mechanism 130 is enabled to feed the uppermost sheet properly.

The upper end detecting switch 113 is integrally mounted on the top door 140 together with the sheet pressers 132 so as to integrally move the upper end detecting switch 113 and the sheet pressers 132 together with an opening/closing operation of the top door 140.

The upper end detecting switch 113 is provided in such a position that is substantially located in the widthwise center of the uppermost sheet of the stacked sheets P on the upstream side with respect to the sheet transport direction when the upper door 140 is closed (see FIG. 2). The switch 113 is constructed in such a manner that a rod-like detecting member with a lead end thereof in a round shape is biased downward by an elastic means such as a spring. The switch 113 detects the uppermost sheet of the stacked sheets P on the sheet stacker 110 by pressing the detecting member downward against the uppermost sheet. It should be appreciated that the detecting member may be pressed against the uppermost sheet by its weight.

Figure 5A:
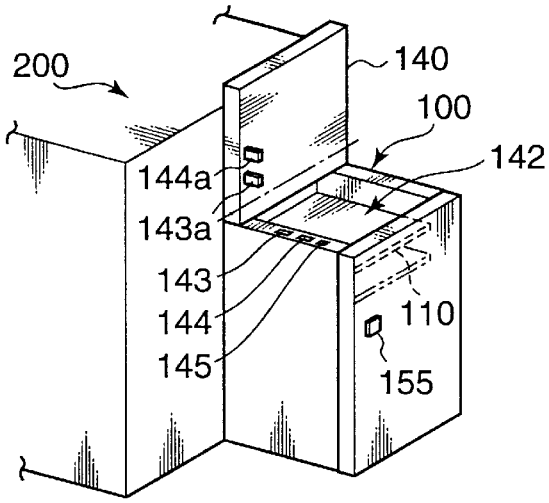
FIG. 5A is a partially perspective view showing a state that a top door of the feeder apparatus is opened.
Figure 5B:
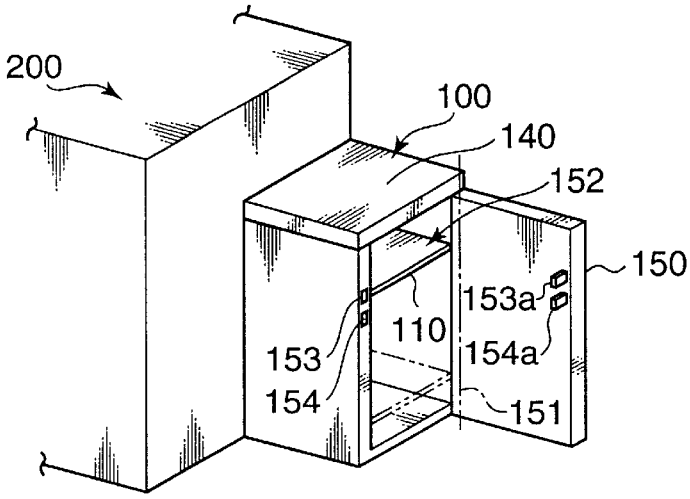
FIG. 5B is a partially perspective view showing a state that a vertical door of the feeder apparatus is opened.
Figure 5C:
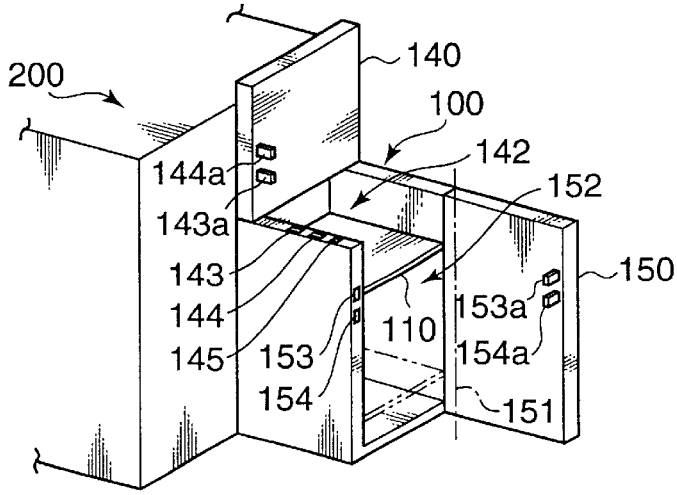
FIG. 5C is a partially perspective view showing a state that the top door and the vertical door of the feeder apparatus are opened altogether.

FIG. 5A is a diagram showing a state that the top door 140 of the feeder apparatus 100 is opened, FIG. 5B is a diagram showing a state that the vertical door 150 of the feeder apparatus 100 is opened, and FIG. 5C is a diagram showing a state that the top door 140 and the vertical door 150 are opened altogether.

The top door 140 is pivotally opened and closed about an axis of a horizontal shaft 141 which is provided on the side of the copying machine main body 200. Opening of the top door 140 allows an operator to reach the sheet stacker 110 through the top opening 142.

The air-suction type sheet transporter 133 (see FIG. 2) constituting a part of the feeding mechanism 130 is mounted on the top door 140. With this arrangement, the integral movement of the sheet transporter 133 together with the top door 140 provides a large space for the opening 142.

First and second top door detecting switches 143, 144 are provided at an appropriate position on the upper frame surface of a front wall constituting the feeder apparatus 100 to detect a status as to whether the top door 140 is opened. Detection projections 143*a*, 144*a* are provided on the backside of the top door 140 at respective corresponding positions of the first and second top door detecting switches 143, 144. When the top door 140 is closed, the detection projection 143*a* (144*a*) is pressed against the top door detecting switch 143 (144) to thereby detect that the top door 140 is closed.

A first lowering enforcement switch 145 is provided at an appropriate position on the upper frame surface of the front wall of the feeder apparatus 100. The upper frame surface of the front wall of the feeder apparatus 100 is exposed outside only when the top door 140 is opened. The operator is enabled to activate the switch 145 to enforce the sheet stacker 110 to move downward when the top door 140 is opened.

The vertical door 150 is pivotally opened and closed about an axis of a vertical shaft 151 which is mounted on a rear wall of the feeder apparatus 100 or at a position away from the copying machine main body 200 (right side in FIGS. 5B and 5C). Opening of the vertical door 150 allows an operator to reach the sheet stacker 110 through the vertical opening 152.

The top opening 152 to be defined by opening of the vertical door 150 is connected with the vertical opening 142 to be defined by opening of the top door 140. With this arrangement, when the top door 140 and the vertical door 150 are opened altogether, a large hollow space including an upper space above the sheet stacker 110 and a side space relative to the sheet stacker 110 is secured inside the feeder apparatus 100 (see FIG. 5C).

First and second vertical door detecting switches 153, 154 are provided at an appropriate position on a side frame surface of the front wall of the feeder apparatus 100 to detect a status as to whether the vertical door 150 is opened. Detection projections 153*a*, 154*a* are provided on the backside of the vertical door 150 at respective corresponding positions of the first and second vertical door detecting switches 153, 154. When the vertical door 150 is closed, the detection projection 153*a* (154*a*) is pressed against the vertical door detecting switch 153 (154) to thereby detect that the vertical door 140 is closed.

A second lowering enforcement switch 155 is provided at an appropriate position on the outer wall of the vertical door 150 (see FIG. 5A). By pressing the switch 155, the operator is enabled to enforce the sheet stacker 110 to move downward.

Figure 6:
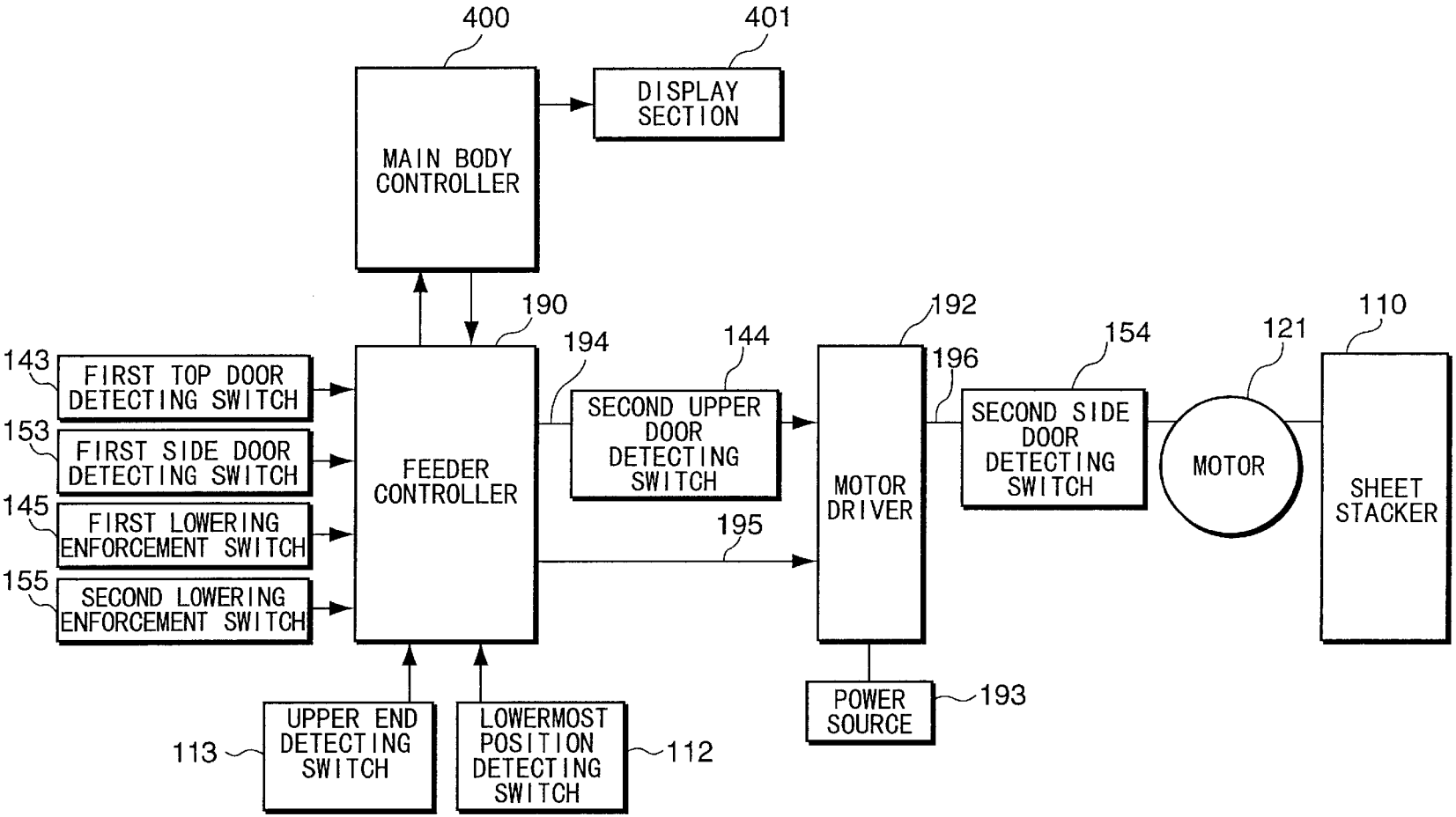
FIG. 6 is a block diagram showing an arrangement of a control system of the feeder apparatus.

FIG. 6 is a block diagram of a control system in the feeder apparatus 100. As shown in FIG. 6, the feeder apparatus 100 comprises a feeder controller 190 which performs various control operations of the feeder apparatus 100, a motor driver 192 which drives the drive motor 121 of the elevating drive mechanism 120 to move the sheet stacker 110 up and down, and a power source 193 which supplies power via the motor driver 192 to drive the drive motor 121.

The feeder controller 190 is interactively communicable with the main body controller 400 so as to transmit and receive various data to and from the main body controller 400. The feeder controller 190 is operated based on various detection signals which are inputted from the first top door detecting switch 143, the first vertical door detecting switch 153, the first and second lowering enforcement switches 145, 155, the upper end detecting switch 113, and the lowermost position detecting switch 112. The feeder controller 190 is electrically connected to an upward control signal transmission line 194 and a downward control signal transmission line 195. The feeder controller 190 transmits a control signal to the motor driver 192 via the circuit 195 to control upward movement of the sheet stacker 110. Likewise, the feeder controller 190 transmits a control signal to the motor driver 192 via the circuit 194 to control downward movement of the sheet stacker 110.

In this arrangement, in the case where the top door 140 is in an opened state, the second top door detecting switch 144 functions as an electrical switch on the upward control signal transmission line 194 to set the circuit 194 in an opened state (namely, render the feeder apparatus 100 in an electrically cut-off state).

The motor driver 192 is electrically connected to the drive motor 121 via a power supply circuit 196 to supply power to drive the drive motor 121 so as to move the sheet stacker 110 up and down.

In this arrangement, in the case where the vertical door 150 is in an opened state, the second vertical door detecting switch 154 functions as an electrical switch on the power supply circuit 196 to set the power supply circuit 196 in an opened state (namely, render the feeder apparatus 100 in an electrically cut-off state).

Next, an operation as to how sheets are replenished into the feeder apparatus 100 is described. First, a case where the top door 140 is opened by an operator is described. It should be appreciated that the vertical door 150 is closed in this case.

When the top door 140 is opened, the first and second top door detecting switches 143, 144 detect that the top door 140 is opened. At this time, the second top door detecting switch 144 sets the upward control signal transmission line 194 in an opened state (to render the feeder apparatus 100 in an electrically cut-off state). This arrangement securely prevents an upward control signal from being transmitted from the feeder controller 190 to the motor driver 192, thereby eliminating a possibility that the sheet stacker 110 is moved upward with the top door 140 left opened. This arrangement eliminates a likelihood that a foreign matter may be intruded in an element inside the feeder apparatus 100.

When the top door 140 is opened, a detection signal indicating that the top door 140 is opened is transmitted from the first top door detecting switch 143 to the feeder controller 190. Then, the feeder controller 190 controls the main body display section 401 via the main body controller 400 to display a message that the top door 140 of the feeder apparatus 100 is opened, and sends a downward control signal to the motor driver 192 via the downward control signal transmission line 195. The downward control signal is transmitted for a duration corresponding to a period for moving the sheet stacker 110 downward by a predetermined height. Upon receiving the downward control signal, the motor driver 192 activates the drive motor 121 in such a manner that power from the power source 193 is supplied to the drive motor 121 by way of the power supply circuit 196 to move the sheet stacker 110 downward.

When the sheet stacker 110 has moved downward by the predetermined height, the operator is allowed to replenish sheets P on the sheet stacker 110 by the volume corresponding to the height. The height for moving the sheet stacker 110 downward may be set desirably, for instance, the thickness corresponding to a bundle of sheets P packed in a package (e.g., 500 sheets).

When the operator presses the first lowering enforcement switch 145 which is exposed outside in an opened state of the top door 140, the feeder controller 190 controls the sheet stacker 110 to move further downward by a predetermined height in a manner similar as the aforementioned case where the top door 140 is opened by the operator, thereby allowing the operator to continue sheet replenishing.

When the sheet replenishing is completed and the operator closes the top door 140, the first and second top door detecting switches 143, 144 detect that the top door 140 is closed.

At this time, activation of the second top door detecting switch 144 renders the upward control signal transmission line 194 in an closed state (namely, allows electricity to flow), thereby allowing the sheet stacker 110 to move upward.

Then, when the feeder controller 190 receives a detection signal from the first top door detecting switch 143 indicating that the top door 140 is closed, the controller 190 controls the display section 401 via the main body controller 400 to suspend display of the message that the top door 140 is opened, and sends an upward control signal to the motor driver 192 by way of the upward control signal transmission line 194. The upward control signal is transmitted for a duration until the upper end detecting switch 113 detects the uppermost sheet of the stack of sheets P on the sheet stacker 110. Upon receiving the detection signal from the upper end detecting switch 113, the motor driver 192 activates the drive motor 121 in such a manner that power from the power source 193 is supplied to the drive motor 121 via the power supply circuit 196 to move the sheet stacker 110 upward. Thus, the sheets P stacked on the sheet stacker 110 are set in a ready-to-be-fed state by the feeding mechanism 130 again.

Next, a case where the vertical door 150 is opened by an operator is described. The operator, when intending to replenish sheets into the feeder apparatus 100 in a sideways direction, presses the second lowering enforcement switch 155 in a state that the vertical door 150 is closed.

When the switch 155 is pressed, a detection signal indicating that the switch 155 is pressed is transmitted from the switch 155 to the feeder controller 190. Then, the controller 190 sends a downward control signal to the motor driver 192 by way of the downward control signal transmission line 195. The downward control signal is transmitted for a duration until the lowermost position detecting switch 112 detects that the sheet stacker 110 has lowered to the lowermost position. Upon receiving the downward control signal from the controller 190, the motor driver 192 activates the drive motor 121 in such a manner that power from the power source 193 is supplied to the drive motor 121 by way of the power supply circuit 196 to move the sheet stacker 110 to the lowermost position. Upon confirming that the sheet stacker 110 has moved to the lowermost position, the operator is allowed to replenish sheets P on the sheet stacker 110 by opening the vertical door 150.

When the vertical door 150 is opened, the first and second vertical door detecting switches 153, 154 detect that the vertical door 150 is opened. At this time, activation of the second vertical door detecting switch 154 renders the power supply circuit 196 in an opened state (namely, electrically cut-off state). This arrangement securely prevents power from being supplied to the drive motor 121 via the motor driver 192, thereby eliminating a possibility that the sheet stacker 110 is moved upward with the vertical door 150 left opened. This arrangement eliminates a likelihood that a foreign matter may be intruded in an element inside the feeder apparatus 100.

When receiving a detection signal from the first vertical door detecting switch 153 indicating that the vertical door 150 is opened, the feeder controller 190 controls the display section 401 by way of the main body controller 400 to display a message that the vertical door 150 is opened. With this arrangement, the operator is notified of the status of the feeder apparatus 100 that the sheet stacker 110 is disabled to move downward because the vertical door 150 is opened. As an altered arrangement, the display section 401 may display an alert that the vertical door 150 be closed.

When the sheet replenishing is completed and the operator closes the vertical door 150, the first and second vertical door detecting switches 153, 154 detect that the vertical door 150 is closed. At this time, activation of the second vertical door detecting switch 154 renders the power supply circuit 196 in a closed state (allows electricity to flow), thereby allowing the sheet stacker 110 to move up and down.

When receiving a detection signal from the first vertical door detecting switch 153 indicating that the vertical door 140 is closed, the feeder controller 190 controls the display section 401 by way of the main body controller 400 to suspend display of the message that the vertical door 150 is opened, and moves the sheet stacker 110 upward to such a height as to enable the feeder apparatus 100 to restart feeding operation in a manner similar as the aforementioned case where the top door 140 is closed.

Next, a case where the top door 140 and the vertical door 150 are opened altogether is described. As mentioned above, the up and down movement of the sheet stacker 110 in a state that the vertical door 150 is left opened is prohibited. Accordingly, at a first stage of sheet replenishing in this case, it is necessary for an operator to press the second lowering enforcement switch 155 in a state that the vertical door 150 is closed.

In this arrangement, as far as the vertical door 150 is left opened, there is no likelihood that the sheet stacker 110 is moved down even if the top door 140 is opened. When the operator closes the top door 140 and the vertical door 150 altogether after completing sheet replenishment, the sheet stacker 110 is enabled to move upward to such a height as to enable the feeder apparatus 100 to start sheet feeding.

According to the invention, the paper feeder apparatus may be modified as follows.

(1) The inventive feeder apparatus is not only attachable to a main body of a copying machine but also may be made attachable to a main body of various image forming apparatus such as facsimile machine and printer to feed sheets to the apparatus main body.

(2) It may be appreciated to provide a single top door detecting switch or single vertical door detecting switch instead of a plurality of switches.

Figure 7:
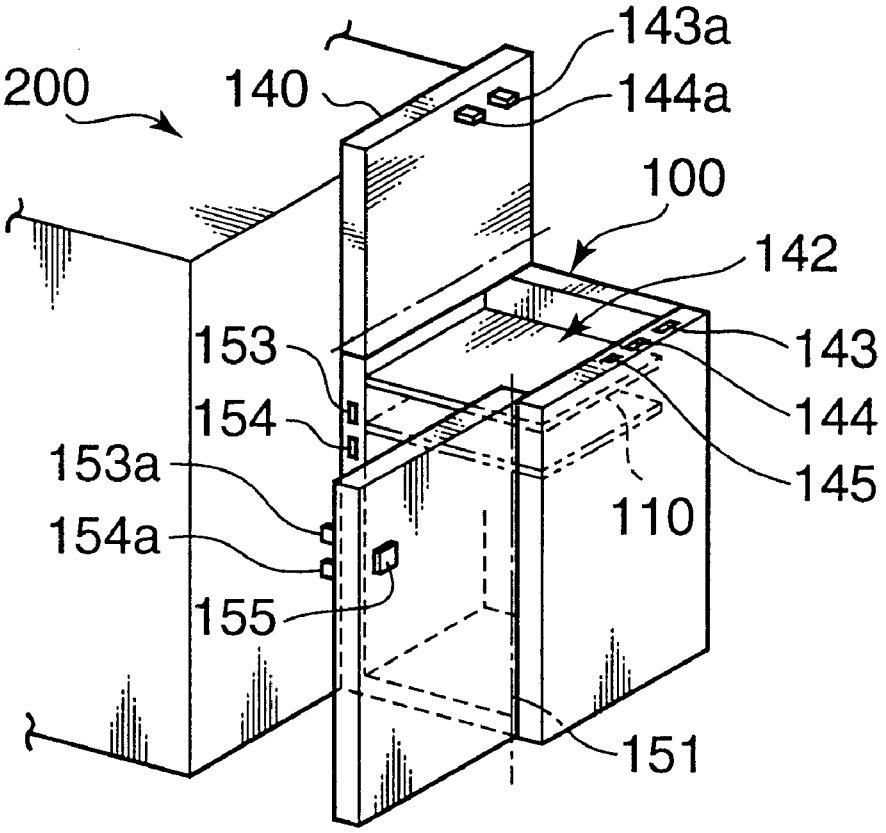
FIG. 7 is a partially perspective view showing a modified paper feeder apparatus.

(3) A vertical door may be provided in a front side of a feeder apparatus as shown in FIG. 7. Specifically, the vertical door is provided in a front wall of the housing that faces an operator standing area where the operator operates the image forming apparatus. It should be noted that like parts are indicated at the same number as the foregoing embodiment.

(4) The feeder controller which controls up and down movement of the sheet stacker may be provided in the main body of the copying machine. In this case, the main body controller may function as the feeder controller.

(5) The feeding mechanism is not limited to the air-type feeding mechanism, and any conventional feeding mechanism such as the one employing a friction retard system or a friction pad system may be applicable.

(6) Sheets may include copy sheets, Overhead Projector (OHP) sheets, paper sheets for copying master drawing, color copy sheets, photosensitive paper sheets, and coated paper sheets for ink jet printer.

(7) The copying machine main body may be operable according to a digital system or analog system.

(8) In the foregoing embodiment, the entirety of the sheet transporter constituting part of the feeding mechanism is mounted on the upper door. Alternatively, the air suction fan may be fixed to the main body of the feeder apparatus. In this case, the air suction duct mounted on the upper door is communicable with the air suction fan when the upper door is closed.

As mentioned above, an inventive paper feeder apparatus is provided with a top door and a vertical door. This arrangement enables to install the feeder apparatus in a relatively smaller space compared with conventional paper feeder apparatus provided with only a vertical door which require a larger space for opening the vertical door. The arrangement of the invention provides a wider choice for the installed location.

In the case where a space for opening the vertical door is secured, the operator can select a sheet replenishing manner according to needs. For instance, in the case where the operator replenishes a relatively small number of sheets, the operator opens the top door and replenishes the sheets in the front direction through the opening defined by opening the top door. On the other hand, in the case where the operator replenishes a large number of sheets, the operator opens the vertical door and replenishes sheets through the larger opening defined by opening of the vertical door. This arrangement enables the operator to remove a jammed sheet by selectively opening the top door or the vertical door which provides easier sheet jam removal.

The opening to be formed by opening of the top door and the opening to be formed by opening of the vertical door are connected with each other. With this arrangement, opening the top door and the vertical door altogether enables to secure an exposed large space including an upper region above the sheet stacker and a side region relative to the sheet stacker. The operator is enabled to replenish sheets through the large space easily and accurately. This arrangement enables the operator to cope with a tricky sheet jam because the operator is easily accessible to the interior of the feeder apparatus through the large space.

An air-suction type sheet transporter of the feeding mechanism is provided on the top door and a part of the sheet transporter is made movable together with the top door. This arrangement enables to provide a large opening by opening of the top door.

In the case where the second top door detecting switch detects that the top door is opened, upward movement of the sheet stacker is prohibited. This arrangement eliminates a likelihood that a foreign matter may be intruded in an element inside the feeder apparatus because there is no possibility of upward movement of the sheet stacker with the top door left opened.

The sheet stacker is allowed to move downward even if the top door is opened. This arrangement enables the operator to move the sheet stacker downward step by step in a state that the top door is opened, thereby facilitating sheet replenishing.

The second top door detecting switch functions as an electrical switch on the upward control signal transmission line through which an upward control signal is transmitted from the feeder controller to the motor driver. With this arrangement, transmission of upward control signal is cut off in the aspect of a hardware construction when the top door is opened, thereby providing improved safety measures for sheet replenishing operation.

In the case where the second vertical door detecting switch detects that the vertical door is opened, up and down movement of the sheet stacker is prohibited. This arrangement enables to eliminate a likelihood that a foreign matter may be intruded in an element inside the feeder apparatus because up and down movement of the sheet stacker with the vertical door left opened is prohibited.

The second vertical door detecting switch functions as an electrical switch on the power supply circuit through which power is supplied to the drive motor (elevating drive mechanism). With this arrangement, in the case where the vertical door is opened, power supply to the drive motor (elevating drive mechanism) is cut off in the aspect of a hardware construction, thereby providing improved safety measures for sheet replenishing operation.

This application is based on patent application Nos. 2000-46229 and 2000-46230 filed in Japan, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A feeder apparatus arranged on a side of a main body of an image forming apparatus to feed sheets to the main body of the image forming apparatus, the feeder apparatus comprising:

a housing having a top opening and a side opening;

a sheet stacker provided in the housing for holding a stack of sheets thereon;

an elevating mechanism for moving the sheet stacker up and down;

a feeding mechanism provided above the sheet stacker to feed the sheets one by one in a sheet transport direction;

a top door which closes the top opening and can be opened by an operator to allow the operator to replenish sheets onto the sheet stacker through the top opening in an opened state; and a side door provided separately from the top door to be operated independently of the top door to close and open the side opening, and allow an operator to replenish sheets onto the sheet stacker through the side opening in an opened state.

2. The feeder apparatus according to claim 1, wherein the side opening is on a side of the housing that is opposite from the main body of the image forming apparatus.

3. The feeder apparatus according to claim 1, wherein the side opening is on a front of the housing.

4. The feeder apparatus according to claim 1, wherein the top opening and the side opening are continuous with each other.

5. A feeder apparatus arranged on a side of a main body of an image forming apparatus to feed sheets to the main body of the image forming apparatus, the feeder apparatus comprising:

a housing having a top opening and a side opening;

a sheet stacker provided in the housing for holding a stack of sheets thereon;

an elevating mechanism for moving the sheet stacker up and down;

a feeding mechanism provided above the sheet stacker to feed the sheets one by one in a sheet transport direction and at least a part of the feeding mechanism being mounted on the top door;

a top door which closes and opens the top opening, and allows an operator to replenish sheets onto the sheet stacker through the top opening in an opened state; and a side door which closes and opens the side opening, and allows an operator to replenish sheets onto the sheet stacker through the side opening in an opened state.

6. The feeder apparatus according to claim 5, wherein the feeding mechanism includes:

a sheet separator which separates an uppermost sheet from the rest of the stack of sheets on the sheet stacker by an air blowing force; and a sheet transporter which transports the uppermost sheet in the sheet transport direction while attracting the uppermost sheet toward the sheet transporter by an air-suction force, a part of the sheet transporter being mounted on the top door.

7. A feeder apparatus arranged on a side of a main body of an image forming apparatus to feed sheets to the main body of the image forming apparatus, the feeder apparatus comprising:

a housing having a top opening and a side opening:

a sheet stacker provided in the housing for holding a stack of sheets thereon;

an elevating mechanism for moving the sheet stacker up and down;

a feeding mechanism provided above the sheet stacker to feed the sheets one by one in a sheet transport direction;

a top door which closes and opens the top opening, and allows an operator to replenish sheets onto the sheet stacker through the top opening in an opened state;

a side door which closes and opens the side opening, and allows an operator to replenish sheets onto the sheet stacker through the side opening in an opened state;

a top door detecting switch which detects a status of the feeder apparatus as to whether the top door is opened; and a side door detecting switch which detects a status of the feeder apparatus as to whether the side door is opened;

wherein the elevating mechanism suspends the upward and downward movements of the sheet stacker when the side door detecting switch detects that the side door is opened, and suspends the upward movement of the sheet stacker when the top door detecting switch detects that the top door is opened.

8. The feeder apparatus according to claim 7, wherein the side door detecting switch includes an electrical switch which is disposed on a power supply circuit for supplying power to the elevating mechanism, and is opened and closed in correspondence with an opening/closing operation of the side door.

9. The feeder apparatus according to claim 7, wherein the elevating mechanism includes a controller which transmits an upward control signal to move the sheet stacker upward and a downward control signal to move the sheet stacker downward, and the top door detecting switch includes an electrical switch which is disposed on an upward control signal transmission line for transmitting the upward control signal to the elevating drive mechanism, and is opened and closed in correspondence with an opening/closing operation of the top door.

10. The feeder apparatus according to claim 7, further comprising means for displaying a message that the top door is open.

11. The feeder apparatus according to claim 7, further comprising means for displaying a message that the side door is open.

12. The feeder apparatus according to claim 7, further comprising means for displaying that at least one of the top door and the side door is open.

13. The feeder apparatus according to claim 1, wherein the side opening is perpendicular to the top opening.

14. The feeder apparatus according to claim 13, wherein the side opening is parallel with a front of the housing.

15. The feeder apparatus according to claim 13, wherein the side opening is perpendicular to a front of the housing.

* * * * *